US005208423A

United States Patent [19]

Goetz

[11] Patent Number: 5,208,423

[45] Date of Patent: May 4, 1993

[54] MECHANICAL SHIELDING FOR ELECTRIC PRIMER

[75] Inventor: Raymond J. Goetz, Baltimore, Md.

[73] Assignee: The United States of America as represented by the Secretary of the Navy, Washington, D.C.

[21] Appl. No.: 874,156

[22] Filed: Apr. 27, 1992

[51] Int. Cl.[5] ..... F42B 5/08; F42C 19/12

[52] U.S. Cl. ..... 102/472; 102/202.5

[58] Field of Search ..... 102/472, 202.5, 204

[56] References Cited

U.S. PATENT DOCUMENTS

| | | | |
|---|---|---|---|
| 3,018,732 | 1/1962 | Tognola | 102/202.8 |
| 3,090,310 | 5/1963 | Peet et al. | 102/472 |
| 3,455,244 | 7/1969 | Ballreich et al. | 102/472 |
| 4,329,924 | 5/1982 | Logofun | 102/202.8 |
| 4,386,567 | 6/1983 | Ciccone et al. | 102/202.5 |
| 4,605,453 | 8/1986 | Spear et al. | 102/204 |

*Primary Examiner*—David H. Brown
*Attorney, Agent, or Firm*—Kenneth E. Walden

[57] ABSTRACT

An electric primer for cartridge ammunition (e.g., Phalanx 20 mm cartridges) is designed to minimize antenna coupling, capacitive coupling, and aperture coupling of stray electromagnetic radiation thereinto for avoiding accidental primer detonation with resulting ignition of cartridge propellant. The primer is provide with a button electrode which is deeply recessed totally behind a small diameter access aperture which physically guards the button electrode from antenna and capacitive coupling. Furthermore, the small opening channels stray radiation about its periphery rather than admitting it to the button.

5 Claims, 4 Drawing Sheets

TEST RESULTS

COMPARISON OF FIRING THRESHOLDS FOR M52A3B1 AND RECESSED BUTTON (GOETZ) PRIMERS.

PRIOR ART

HF FREQUENCIES

| FREQUENCY (MHz) | TEST ENVIRONMENT (V/m) | M52A3B1 THRESHOLD (V/m) | RECESSED BUTTON THRESHOLD (V/m) |
|---|---|---|---|
| 4.040 | 200 | 75* | >200 |
| 4.803 | 200 | 100* | >200 |
| 5.383 | 200 | 100* | >200 |
| 6.400 | 200 | 5* | 100* |
| 6.970 | 200 | 15* | >200 |
| 7.595 | 200 | 20* | >200 |
| 9.050 | 200 | 5* | 200* |
| 9.803 | 200 | 7.5* | >200 |
| 11.054 | 200 | 15* | >200 |
| 12.045 | 200 | 50* | >200 |
| 13.530 | 200 | 100* | >200 |
| 16.060 | 200 | 25* | >200 |
| 17.048 | 150 | 10* | >150 |
| 18.036 | 150 | 20* | >150 |
| 19.270 | 200 | 75* | >200 |
| 20.510 | 200 | 60* | >200 |
| 21.460 | 200 | 100* | >200 |
| 23.180 | 200 | 40* | >200 |
| 24.450 | 173 | 20* | >173 |
| 26.875 | 200 | >200 | Not Tested |

*INDICATES THAT PRIMER FIRED AT THAT ENVIRONMENT LEVEL. ANY VALUES PRECEDED WITH A ">" SIGN INDICATE THE PRIMER DID NOT FIRE AT MAXIMUM TEST ENVIRONMENT.

TEST RESULTS

COMPARISON OF FIRING THRESHOLDS FOR M52A3B1 AND RECESSED BUTTON (GOETZ) PRIMERS.

PRIOR ART

RADAR FREQUENCIES

| FREQUENCY (MHz) | TEST ENVIRONMENT (mW/cm2) | M52A3B1 THRESHOLD (mW/cm2) | RECESSED BUTTON THRESHOLD (mW/cm2) |
|---|---|---|---|
| 215 | 20.4 | 0.625* | >20.4 |
| 425 | 67 | 0.5* | >67 |
| 2720 | 400 | >400 | >400 |
| 2900 | 400 | >400 | >400 |
| 5650 | 400 | 160* | >400 |
| 7800 | 150 | >150 | >150 |

*INDICATES THAT PRIMER FIRED AT THAT ENVIRONMENT LEVEL. ANY VALUES PRECEDED WITH A ">" SIGN INDICATE THE PRIMER DID NOT FIRE AT MAXIMUM TEST ENVIRONMENT.

MECHANICAL SHIELDING FOR ELECTRIC PRIMER

BACKGROUND OF THE INVENTION

This invention relates to a primer for cartridge casings for projectile ammunition, such as, but not limited to 20 mm Phalanx cartridges used by the military. Technology has long passed beyond percussion initiation of primers for shell cartridges having high rate of fire for military applications. Instead, primers containing pyrotechnic compositions are now electrically initiated. This initiation is accomplished by a relatively simple process of bringing a current-carrying plunger in the gun breech structure up behind the backside of the cartridge casing, once the cartridge is properly chambered, to electrically contact a button electrode therein for completing an electrical circuit through the primer button for initiating detonation of pyrotechnic composition in the circuit path. Detonation of the primer pyrotechnic composition in turn ignites propellant inside the cartridge casing.

Electrical initiation of cartridge primers is now common practice. Usually an explosive pyrotechnic material is made conductive and sandwiched between a pair of electrical conductors inside the primer. Current is passed through the pyrotechnic material from one conductor to the other to generate a temperature rise in the material sufficient to initiate its detonation. The detonating pyrotechnic material in turn ignites propellant in the cartridge casing to propel a projectile forward.

The electromagnetic environment aboard ships and aircraft, as well as on other military equipment, has increased substantially in recent years along with the increased use of electronic equipment. It is in this dense atmosphere of electromagnetic radiation that cartridges having electrically fired primers are stored, handled and used. High-power radar, for example, and communication equipment emit strong electromagnetic fields to the surrounding environment.

The problem of ammunition firing caused by stray or misdirected electromagnetic radiation has long been recognized. Numerous approaches have been proposed to alleviate or counter this condition. Prior art systems for electric fired primers have proposed inductive and capacitive components that form a balanced bridge to shunt unwanted signals. U.S. Pat. No. 3,181,464 employs special conductors, while U.S. Pat. No. 4,304,184 uses one or more inductors and ferrite beads to absorb unwanted current flow. RF attenuation is proposed in U.S. Pat. No. 4,848,233 by providing a conductive path in a special spiral shape with at least one reversal of direction embedded in ferrite material. Still other recent approaches are indicated in U.S. Pat. Nos. 4,893,563; 4,967,665; and 5,036,768. More recently, in U.S. Pat. No. 5,027,707 it is proposed to provide the conductive pyrotechnic mixture with a carbon layer to provide a parallel resistive current path in addition to the path through the conductive mixture.

Stray electromagnetic radiation can be coupled into an electroexplosive cartridge primer to initiate unwanted detonation Propagation of radiated electromagnetic energy into the primer, requires a coupling mechanism from the external environment. Coupling mechanisms generally fall into one of three categories (1) antenna coupling, (2) capacitive coupling, or (3) aperture coupling.

Antenna coupling is a mechanism by which an electrically conductive object exposed to the external radiated electromagnetic environment transforms radiated energy into conducted energy and, if that object is allowed to contact a sensitive system element, transfers this energy to that sensitive element or component. Any electrically conductive object, e.g., wires, tools, human beings, etc., can act as unwanted antennas.

Capacitive coupling requires a conducting object (antenna) in proximity to a sensitive element (e.g., primer button). At frequencies from the upper end of the communications range through the lower end of the radar range, it is possible to couple RF energy by virtue of the capacitance that exists between external objects and the primer button.

Aperture coupling is a mechanism by which radiated electromagnetic energy couples directly from an external environment into sensitive system elements or components via holes, seams, or other openings. Generally, this entry path is more efficient at frequencies where the wavelength is small compared to the dimensions of the opening.

SUMMARY OF THE INVENTION

It is, therefore, an object of the invention to provide a cartridge electronic primer which minimizes opportunity of initiation by stray electromagnetic radiation.

It is another object of the invention to provide an electric primer which minimized opportunity for antenna coupling, capacitive coupling, and aperture coupling of electromagnetic radiation to within a primer from an electromagnetically charged external environment.

It is still another object of the invention to provide an electric primer having components arranged in a manner to minimize coupling from outside sources of stray electromagnetic radiation.

It is yet another object of the invention to provide an electric primer having an ignition button electrode positioned deep within the primer and behind a limited access opening thereto for minimizing ingress of stray electromagnetic radiation.

It is finally another object of the invention is provide an electric primer having a primer button fully recessed behind a small access opening thereto to mechanically minimize stray electromagnetic radiation onto the button and minimize opportunity of antenna contact or capacitive coupling.

DETAILED DESCRIPTION OF PREFERRED EMBODIMENT

Figure 1:
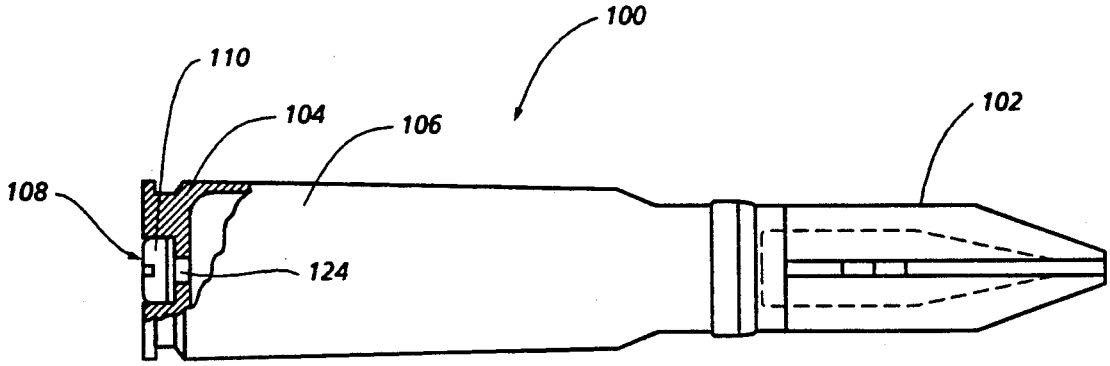
FIG. 1 is side view of a 20 mm cartridge round with the base of the casing partially cut away to illustrate the location of the electric primer.

For a setting in which the present invention is adapted for use, refer to FIG. 1, which is a partial cross-sectional view of a 20 mm cartridge 100 employing a sabot round 102. The aft end or base 104 of cartridge casing 106 is illustrated in cross-section to expose an electric primer, identified generally by the numeral 108, in position therein. Casing 106 is made of electrically conductive material such as brass, through which current flows when a circuit is completed for initiating detonation of pyrotechnic material in the primer.

Figure 2:
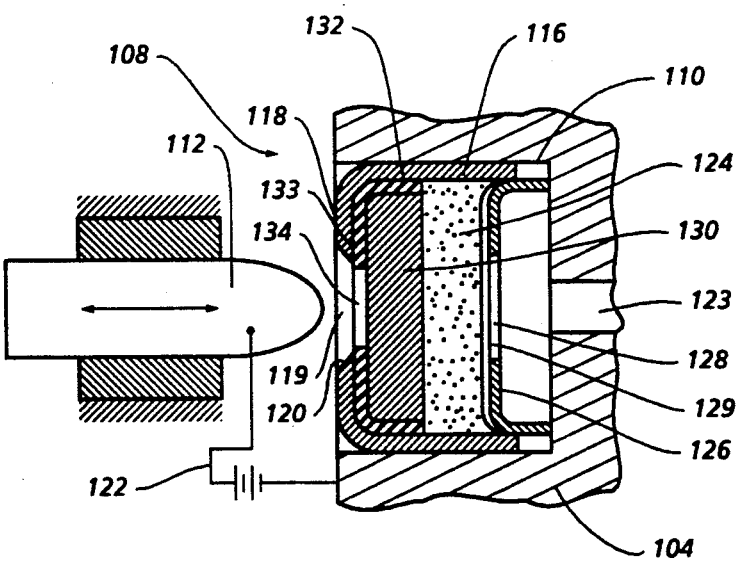
FIG. 2 is a greatly enlarged cross-sectional view of the improved primer positioned in a cartridge recess with an electrode plunger adapted for making electrical contact to complete a firing circuit through the primer.

Refer now to FIG. 2 of the drawings where primer 108 is shown in greatly enlarged cross-sectional detail and positioned in a recess 110 formed in casing base 104. Primer housing 116, also formed of conductive material, is designed to physically retain several components making up the primer. Primer housing 116 is in the form of a cup having a cylindrical side wall and flat end or base wall 118 which is provided with an axially disposed small diameter opening 119 extending therethrough, preferably with a chamfered inlet 120. There is further illustrated in FIG. 2 a firing circuit. When plunger 112 is moved forward by a camming action (not illustrated), it completes a powered circuit 122 through the primer to initiate a pyrotechnic charge therein.

Primer housing 116 is adapted to have its cylindrical side wall press-fitted or otherwise secured in cylindrical recess 110 in cartridge base 104 with its open end facing forward toward propellant (not illustrated) in the cartridge casing. A small axially disposed opening 123 is proved in base 104 for allowing the products of primer detonation to reach propellant forward in the casing.

Referring in more detail to the primer, as illustrated in FIG. 2, an electrically conductive pyrotechnic material 124 is located inside housing 116 in electrical contact with the cylindrical side wall. The pyrotechnic material is adapted to be detonated upon having sufficient current passed through it. The cup-shaped housing 116 may be provided with a slight taper on its cylindrical wall for receiving a cover 126 in press-fit. The central portion of cover 126 is provided with an opening 128, and a thin sheet or membrane 129 may be provided to lie between the cover and pyrotechnic material 124. A primer button electrode 130 is positioned in cup 116 aft of pyrotechnic material 124 with its forward face in electrical contact with the material. The aft portion of the button electrode terminates in a flat generally planar surface which extends entirely thereacross and faces the generally planar inner face of base wall 118 of housing 116. Insulating material 132, also in the form of a cup having a cylindrical side wall and inturned end wall 133, encircles the periphery and aft portion of button 130 for spacing and electrically insulating it from the side and end wall of housing 116. End wall 133 spaces the aft face of button electrode 130 from inturned end wall 118 a considerable distance as illustrated in FIG. 2, for example, and as further detailed in FIG. 6. End 133 is provided with a central opening 134 which is coaxially disposed with respect to opening 119 for allowing entry of firing plunger 112 to make electrical contact with the aft face of button electrode 130.

Figure 3:
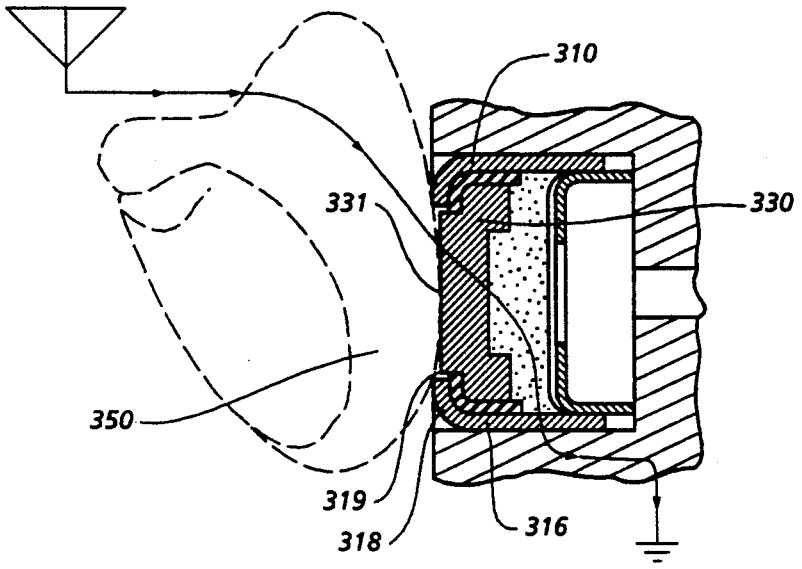
FIG. 3 PRIOR ART
FIG. 3 is a greatly enlarged cross-sectional view of a typical prior art primer in position within a cartridge casing, and with a finger of a human hand in contact with a button thereby completing a circuit for illustrating primer vulnerability to antenna coupling.
Figure 4:
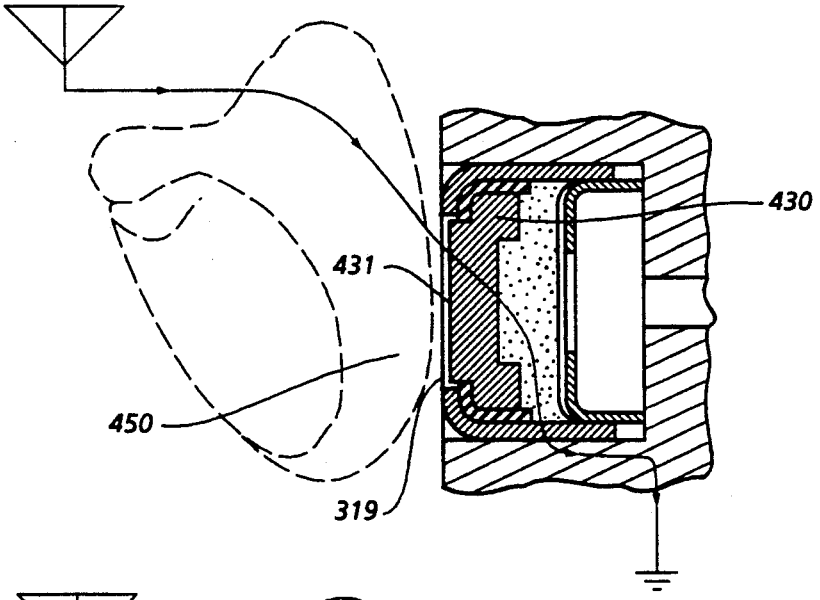
FIG. 4 PRIOR ART
FIG. 4 is another greatly enlarged cross-sectional view of the same FIG. 3 typical prior art primer in position within a cartridge casing, and with the human finger in proximity thereto for illustrating the primers vulnerability to capacitive coupling across a gap.

It will be seen, therefore, that aligned openings 119 and 134 are of relatively small diameters when compared to corresponding openings in the primer illustrated in FIGS. 3 and 4. Furthermore, it will be noted that the aft facing surface of button electrode 130 in FIG. 2 is deep-set within the primer housing relative to that illustrated in FIGS. 3 and 4. Openings 119 and 134 are of sizes just sufficient to just allow entry of the tip of plunger 112 for contacting button electrode 130 to complete an electrically powered circuit through button 130, pyrotechnic material 124, and cylindrical wall of housing 116 to cartridge case base 104.

Figure 5:
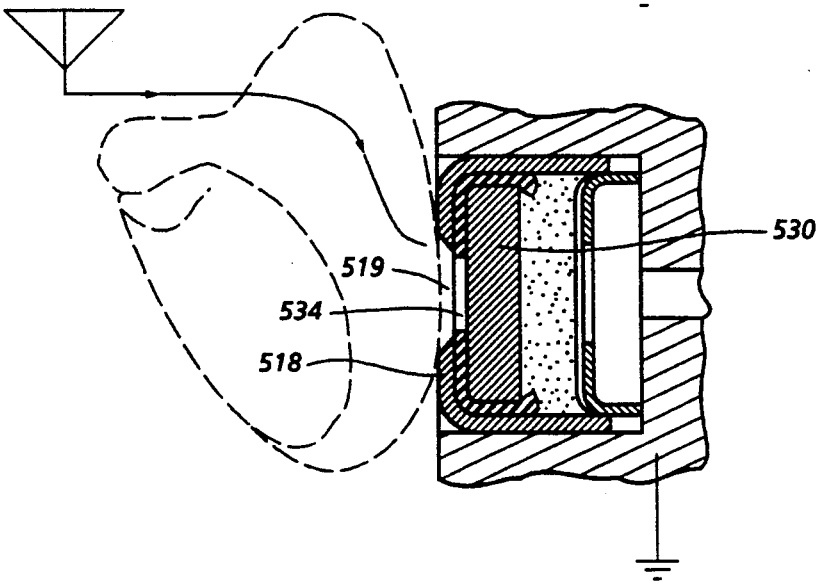
FIG. 5 is a greatly enlarged cross-sectional view of the improved primer in position in the shell casing with a human finger illustrated as unable to make antenna coupling or capacitive coupling with the primer button electrode.

The advantage of the primer design as presented in FIG. 2 is that it minimizes opportunity for antenna coupling, capacitive coupling, and aperture coupling when compared with previous primer designs, such as illustrated in FIGS. 3 and 4. Of radio frequency couplings into electrically fired primers, antenna coupling is most likely at the lower end of the radio frequency (RF) spectrum, i.e., at frequencies below 100 MHz. An example of antenna coupling is illustrated in FIG. 3 wherein primer housing 318 has a large end-opening 319 exposing a vast area of button electrode 330 which includes a protruding area 331 which is nearly flush with the outer extremity of housing base wall 318. It will be noted in FIG. 3, with the vast open exposure of electrode surface area 331, that direct contact with a human hand (finger 350) or tool (not illustrated) is easily made. In this case, the human body may act as an antenna and the hand or tool for carrying a charge directly to electrode 330. Thus, a circuit is completed to ground as indicated by the arrows, and the primer may be detonated. It will be noted in FIG. 5, where a human finger is illustrated adjacent the primer made according to the present invention, that actual contact with the electrode is not possible because button electrode 530 is deep set behind a small aperture, thus effectively preventing incidental contact, such as can occur when ammunition is being handled.

Aperture coupling is more likely to occur at frequencies above 100 MHz. The Navy's use of the RF spectrum can be divided into two ranges, the so-called HF communication range (2–30 MHz) and the radar range (200–40,000 MHz). Thus, the problems that result for a primer of the type employed in cartridges are attributable to antenna coupling at HF and aperture coupling at radar frequencies. Aperture coupling is a mechanism by which radiated electromagnetic energy couples directly from an external environment into sensitive elements or components via holes, seams, or other openings. Generally this entry path is more efficient at frequencies where wavelength is small compared to dimensions of opening(s). Navy radar, for example, generally operates between 200 and 10,000 MHz with corresponding wavelengths between 1.5 and .03 meters, respectively. For effective coupling, an opening would have to be greater than around one inch. In the present invention this opening is approximately one tenth of an inch (0.110"). Thus, coupling through a deep set opening of this size to reach the button electrode is not likely. Such would not be the case for the primer illustrated in FIGS. 3 and 4, wherein opening 319 (FIG. 3) is much greater and vast surface area 331 of electrode 330 is practically flush with the outer face of base wall, 318.

There is a coupling transition region which overlaps antenna coupling and aperture coupling in which capacitive coupling can be a significant propagation mechanism. This effect is similar to antenna coupling except that direct contact with the button electrode is not necessary. Small separation distances between the antenna (finger 450 in FIG. 4, for example) and sensitive element (button electrode 430) can be electrically bridged by the capacitance between the two, and RF energy can couple via this capacitance bridge to ground as indicated by the arrows. Note in FIG. 4 the ease with which a human finger (or other tool) can approach surface 431 of relatively exposed button electrode 430. Note in FIG. 5 that finger contact with button electrode 530 is much less likely to occur because the electrode is deeply recessed behind small opening 519.

Total protection for electrical primers across the entire spectrum employed by Navy electronics requires that design measures address the three coupling possibilities. The present invention offers significant protection against all three, and thereby enhances the immunity of the primer to unintentional initiation across the RF spectrum.

Figure 6:
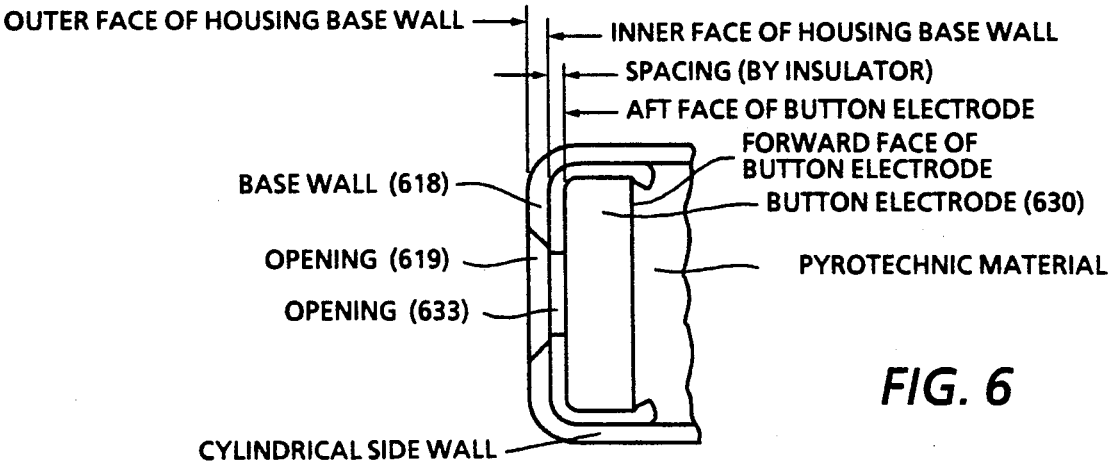
FIG. 6 is a greatly enlarged cross-sectional representation of a portion of the improved primer with certain parts and surfaces labeled for clarification of terminology.

The physical arrangement, terminology and relationship of various elements making up the invention are illustrated in FIG. 6. With the aft surface of button electrode 630 deep set behind small openings 619 and 633, it will be appreciated that close proximity spacing or actual contact with button electrode 630 by an outside objects, such as by a conductive metal tool or a portion of the human hand, for capacitive coupling or antenna coupling, respectively, is not likely. With small opening 619 in the base wall and deep set button electrode 630, aperture coupling of electromagnetic radiation in the radar range is unlikely for the reasons heretofore mentioned in the specification. It will be noted that the opening in the housing end wall is less than half the inside diameter of the cylindrical wall.

Figure 7A:
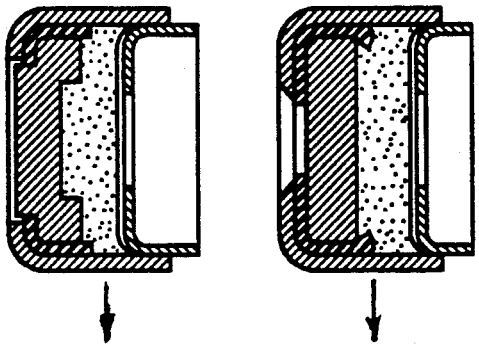
FIG. 7A is a table showing HF frequency firing threshold test results conducted on primers according to the present invention versus previously used primers.
Figure 7B:
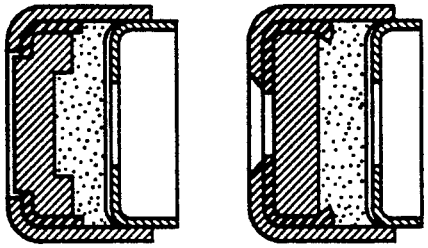
FIG. 7B is another table showing radar frequency firing threshold test results conducted on primers according to the present invention versus previously used primers.

There has been presented in the drawings and supporting specification an electric primer which is less susceptible to initiation by stray electromagnetic radiation via antenna coupling, capacitive coupling, or aperture coupling. Extensive tests have been conducted on the new electric primer versus an electric primer previously employed by the Navy in like environments, and in all instances the new primer described herein was found to be superior. FIGS. 7A and 7B are tabulations of the results of these extensive tests for comparing firing thresholds for a previous primer designated as M52A3B1 and the new recessed button primer according to the present invention.

TEST RESULTS

The test environment was generated electromagnetic radiation for essentially assimilating the electromagnetic environment that would be present on board ship, aircraft, or helicopters. At least one primer of each model M52A3B1 and one recessed button electrode model (Goetz) was tested at each frequency. The test results shown in FIGS. 7A and 7B best speak for themselves in illustration that the present invention (Goetz recessed button) was more effective than the Navy's previously used primer (model M52A3B1) in reducing detonation from radiation at like levels. Note, for example, that at a frequency of 4.040 MHz in the environment of 200 volt/meters test, the lowest threshold at which at least one primer of model M52A3B1 fired was 75 volt meters, whereas none of the recessed button primers (Goetz) fired at the maximum environment level. It will be noted in FIG. 7A that at least one model M52A3B1 primer fired at every test frequency environment level far below the 200 volt/meter test environment from −4.040 MHz through −24,450 MHz. At the −26.875 MHz level, one model M52A3B1 primer fired at 200 volts/meter. No recessed button primer was tested at this level. Of all the recessed button primers tested, only two fired, one at 100 volts/meter and another at 200 volts/meter. However, compare these firing levels with the firing levels of model M52A3B1 primers.

In the radar frequency range of 215 MHz to 7800 MHz, where primers were tested and recorded in FIG. &B, it will be noted that none of the Goetz recessed button primers fired, while three model M52A3B1 primers fired at threshold levels substantially lower than the level where the Goetz primers did not fire. Various test configurations were selected to create the most stressful conditions at each frequency.

Modifications and variations to the present invention are possible in light of the foregoing teachings. It is, therefore, to be understood that within the scope of the appended claims the invention may be practiced otherwise than as specifically described.

What is claimed is:

1. In a cartridge including a case having an aft facing recess in the base thereof for receiving an electrically activatable primer for igniting propellant in the case, said primer comprising:

an electrically conductive primer housing in the form of a cup having a base wall, and a cylindrical side wall adapted to be fitted in the base recess with the base wall facing aft;

said base wall including a generally planar inner face and an axially disposed opening extending therethrough for allowing entry therethrough of an electrically charged plunger;

an electrically conductive pyrotechnic charge disposed inside the cup housing in electrical contact with the side wall thereof;

a button electrode disposed inside the cup housing in electrical contact with the pyrotechnic charge and having a generally planar surface facing the base wall inner face for receiving electrical contact with the entering plunger; and, means insulating the button electrode from the cup housing walls, and having a thickness sufficient for spacing the button electrode inside the base wall with the planar surface of the button electrode disposed entirely inside the cup housing and spaced inwardly from the generally planar inner face thereof for minimizing opportunity for coupling of stray electromagnetic radiation to the button electrode.

2. The invention according to claim 1 wherein the diameter of the opening in the housing end wall is less than half the inside diameter of the cylindrical wall.

3. The invention according to claim 1 wherein the distance between the inner face of the base wall and the planar surface of the button electrode is substantially equal to the thickness of the base wall.

4. The invention according to claim 1 further defined by the insulating means having an axially extending opening for allowing entry therethrough of the plunger for circuit completing contact with the button electrode surface.

5. The invention according to claim 4 wherein the diameter of the opening in the housing end wall is less than half the inside diameter of the cylindrical wall.

* * * * *